United States Patent [19]

Itagaki

[11] 4,140,104

[45] Feb. 20, 1979

[54] HOT WATER FEEDING DEVICES

[75] Inventor: Katsunari Itagaki, Azuma, Japan

[73] Assignee: Sankyo Electric Company Limited, Isesaki, Japan

[21] Appl. No.: 685,916

[22] Filed: May 12, 1976

[30] Foreign Application Priority Data

May 12, 1975 [JP] Japan ..... 50-61203[U]
May 26, 1975 [JP] Japan ..... 50-69670[U]

[51] Int. Cl.[2] ..... F24H 1/20

[52] U.S. Cl. ..... 126/374; 219/308; 219/314; 219/334; 222/70; 222/330

[58] Field of Search ..... 126/350, 351, 344, 374; 219/297, 308, 310, 314, 327, 334; 222/70, 330

[56] References Cited

U.S. PATENT DOCUMENTS

| | | | |
|---|---|---|---|
| 1,926,252 | 9/1933 | Wright et al. | 219/314 |
| 2,115,601 | 4/1938 | Whitby et al. | 219/314 |
| 3,016,930 | 1/1962 | Dziedziula et al. | 222/330 |
| 3,031,102 | 4/1962 | Storms | 222/70 |
| 3,133,671 | 5/1964 | Christine et al. | 219/314 |

FOREIGN PATENT DOCUMENTS

| | | | |
|---|---|---|---|
| 661,092 | 5/1938 | Fed. Rep. of Germany | 219/314 |

*Primary Examiner*—John J. Camby
*Assistant Examiner*—Larry I. Schwartz
*Attorney, Agent, or Firm*—John M. Calimafde

[57] ABSTRACT

A hot water feeding device having an upper water tank and a lower water tank connected with the upper tank by a conduit. The water is heated by heater means provided for the lower tank. The hot water is selectively taken out from the lower tank through a port. An additional pipe is provided for the lower tank which communicates therewith through the upper wall of the lower tank. The additional pipe upwardly extends through a bottom wall and the interior of the upper tank and opens over the current water level of the upper tank.

A plurality of pipes may be provided between the lower tank and the port. Different amounts of hot water may be selectively taken out during a constant time period by opening selected valve means of the additional pipes.

1 Claim, 3 Drawing Figures

HOT WATER FEEDING DEVICES

BACKGROUND OF THE INVENTION

This invention relates to hot water feeding devices and, in particular, to such devices including an upper tank and a lower tank.

There is a known hot water feeding device which includes an upper tank connected with a water feeding pipe and a lower tank being connected with the upper tank by a conduit and having heater means and a hot water port.

The device of this type is superior to a device including a single water tank because hot water of a predetermined temperature, such as bailed water, can be readily and reliably obtained.

In the device of the two tank type, the conduit for connecting between the upper and lower tanks is so designated that the water heated in the lower water is sufficiently cycled into the upper tank therethrough without a temperature of the water in the upper tank being higher than that in the lower tank.

The conduit serves for not only feeding the water from the upper tank to the lower tank but also permitting air or steam to flow therethrough.

In case the lower tank is not filled to a certain level, the steam in the lower tank is rapidly cooled when water is supplied through the conduit, so that the inner pressure of the lower tank is lowered. Thus the lower tank is subjected to deformation because water flows through the conduit from the upper tank and prevents the air from flowing into the lower tank.

Furthermore, when water is fed to the upper and lower tanks before the device is operated, the lower tank is sometimes not filled with water because the air in the lower tank is not so sufficiently exhausted through the conduit by the disturbance of water flowing down therethrough. In this instance the device is subjected to destruction by following water heating.

The hot water feeding device is sometimes used in automatic selling machines or vending machines, such as coffee or other goods selling machines. In that case, required amount of hot water is different in each good. Accordingly, it is desired that different amounts of hot water are fed during a constant time period.

SUMMARY OF THE INVENTION

An object of this invention is to provide a hot water feeding device of a two tank type in which the lower tank is not subjected to the deformation due to the lowered interior pressure, and in which the lower tank is completely filled by water when the water is supplied to the tanks before operation.

Another object of this invention is to provide a hot water feeding device of a two tank type in which hot water of different amounts is always taken out during a constant time period.

According to this invention, the lower tank of the hot water feeding device of a two tank type is provided with an additional pipe which communicates with the lower tank through the upper wall thereof, extends upwardly therefrom through the bottom wall and the interior of the upper tank and opens over the water level of the upper tank.

In another aspect of this invention, the lower tank is provided with a plurality of hot water feeding pipes which are connected to a common hot water port. Each pipe is provided with an electromagnetically operated valve means which is selectively operated by a timer circuit during a constant time period. Accordingly, hot water of different amounts is taken out during a constant time period by selecting the valve means to be operated.

Further objects and features of this invention will be understood from following descriptions of this invention in connection with embodiments of this invention referring to the annexed drawings.

BRIEF DESCRIPTIONS OF THE DRAWINGS

DETAILED DESCRIPTION OF PREFERRED EMBODIMENTS

Figure 1:
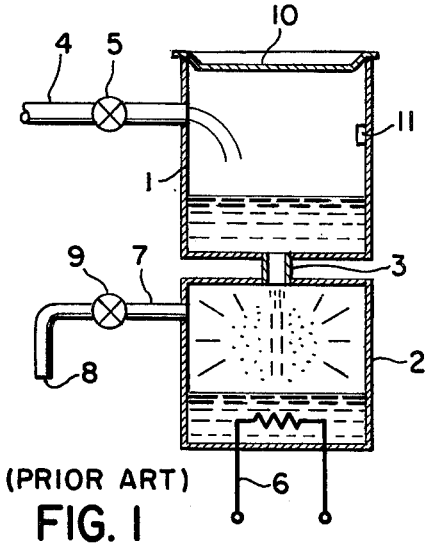
(PRIOR ART) FIG. 1
FIG. 1 illustrates a known hot water feeding device of a two tank type.

Referring to FIG. 1, a known hot water feeding device of a two tank type comprises an upper water tank 1 and a lower water tank 2. The lower tank 2 is interconnected with the upper tank 1 by a conduit 3 which communicates with the upper tank 1 through the bottom wall thereof and with the lower tank 2 through the upper wall thereof.

A water feeding pipe 4 is provided for the upper tank 1, through which water is supplied to the upper tank. A water valve 5 is provided for the pipe 4 for controlling the water supply.

In the lower tank 2, a heater element 6 is provided to heat the water in the tank. The heater element is energized by electric power from a power source (not shown) and the energization may be so controlled as well known in prior arts to maintain the water at a predetermined constant temperature.

A pipe 7 is led out from the lower tank 2 and terminates at a port 8 through a valve 9, to take out the hot water in the lower tank 2.

The upper tank 1 is a top-open tank which has a removable lid 10.

In the upper tank 1, a water level detector 11 is provided to detect a water level in the upper level and to control the valve 5. As the valve 5, an electromagnetically operated valve may be employed and a water level detector of a known float type may be employed. The valve 5 is opened to supply water into the upper tank 1 when the water level in the upper tank is lower than a predetermined water level.

The conduit 3 serves not only for supplying water from the upper tank 1 to the lower tank 2 but also for cycling the heated water from the lower tank 2 into the upper tank 1 to preheat water in the upper tank.

Furthermore the conduit 3 serves for permitting gas to flow therethrough.

The size of the conduit 3 is so designated that the heated water in the lower tank 2 may be cycled to the upper tank 1 enough to preheat the water in the upper tank 1 without elevating the water temperature in the upper tank 1 higher than that in the lower tank 2. Namely, the size of the conduit 3 is not so large.

Accordingly, in case the lower tank 2 is not filled to a certain level, the lower tank 2 is deformed when the water is supplied because the water flowing into the lower tank 2 through the conduit 3 cools the steam to lower the interior pressure in the lower tank 2 and disturbs air flow into the lowered pressure tank 2.

On the other hand, when water is supplied into tanks before the operation of the device, air in the lower tank 2 is exhausted through the conduit 3. But sometimes the air is not sufficiently exhausted by the disturbance of water flowing down into the lower tank 2. This results in the destruction of the device at the operation of the device.

Figure 2:
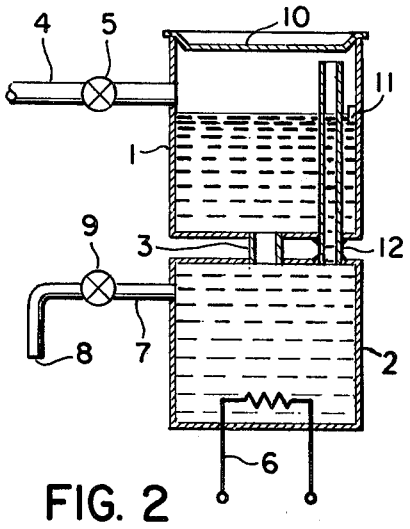
FIG. 2 illustrates an embodiment of this invention.

Referring to FIG. 2, an embodiment of this invention has a similar construction as FIG. 1 but is characterized by the provision of an additional pipe 12.

Similar parts are designated by same reference numerals as FIG. 1.

The additional pipe 12 communicates with the lower tank 2 through the upper wall thereof and extends upwardly through the bottom wall and the interior of the upper tank 1. The open end of the additional pipe 12 is over the current water level in the tank 1.

The additional pipe 12 serves for permitting air to flow into the lower tank 2 or from the lower tank 2. Therefore the deformation of the lower tank and the destruction of the device as seen in the known device in FIG. 1 are overcome. Namely, in case the lower tank 2 is not filled by water, even if the inner pressure of the lower tank 2 is lowered by the supply of water through the conduit 3, air flow into the lower tank 2 will take place through the additional pipe 12. Thus, the lower tank 2 is not deformed. Moreover, when water is supplied into the lower tank 2 through the conduit, air in the lower tank 2 escapes through the additional pipe 12.

It is natural that the additional pipe 12 is welded to the bottom wall of the upper tank 1 and the upper wall of the lower tank 2 to prevent water from leaking, similarly as the conduit 3.

Tanks 1 and 2 may be made of stainless steel and covered by heat insulating material as is known in prior arts.

It will be understood that the provision of the additional pipe 12 neither enlarges the device nor degrades the heat efficiency of the device.

In this embodiment, one pipe is provided for the lower tank to take out the hot water in the lower tank 2. Therefore the more hot water is required, the longer the valve 9 must be open. It is desired that hot water of different amounts can be obtained during a same time period. This is preferable in case the hot water feeding device is assembled into an automatic selling machine for selling different goods which require different hot water amounts.

Figure 3:
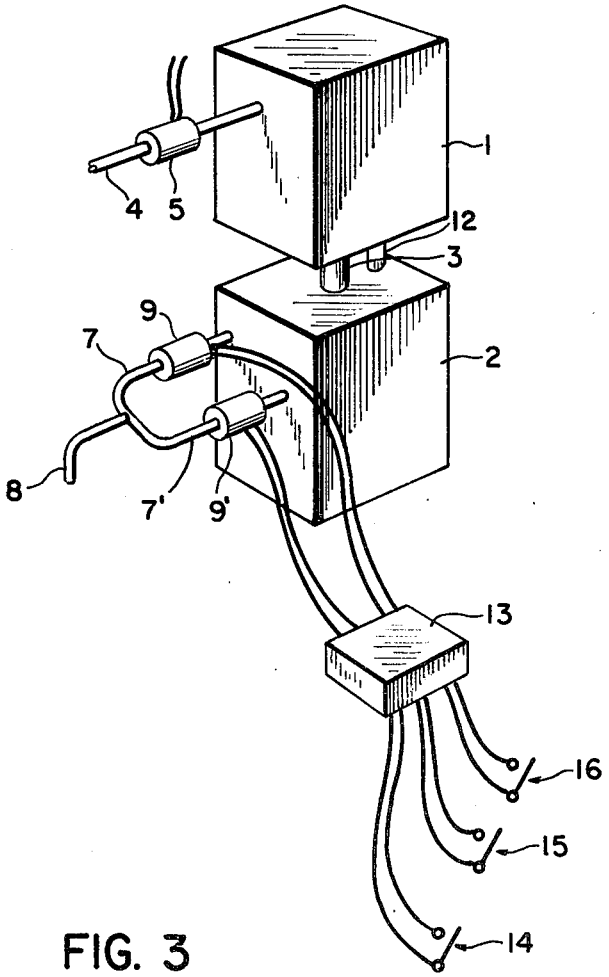
FIG. 3 illustrates another embodiment of this invention.

To this end, referring to FIG. 3, a plurality of, for example two as shown, pipes 7 and 7′ of different sizes are provided for the lower tank 2. These pipes are provided with electromagnetically operated valves 9 and 9′, respectively and are connected to a common port 8.

The two valves 9 and 9′ are connected to a control circuit 13 through electric leads.

The control circuit 13 comprises an electric power source, and a timer for defining a time period during which the electric power is fed to selected valve 9 or 9′. Manually operated switches 14–16 are for selecting valve or valves to be opened. In this embodiment, when switch 14 is closed, the valve 9 is opened during the time period defined by the timer. When the switch 15 is closed, another valve 9′ is opened during same period. And when the other switch 16 is closed, both valves 9 and 9′ are opened during same period.

Accordingly, different feeding (for example 100 ml., 200 ml. and 300 ml.) amounts of hot water are selected by switches 14–16, and hot water of any selected feeding amount can be obtained during a constant time period.

This invention has been described in conjunction with specific embodiments, but it will be understood to those skilled in the art that this invention is not restricted to the embodiments but various other designations and modifications are made within the scope of this invention. What is claimed is:

1. A hot water feeding device including an upper water tank, a lower water tank, a conduit communicating between said upper and lower water tanks through a bottom wall of said upper water tank and an upper wall of said lower water tank, a water feeding pipe for feeding water into said upper water tank, a first valve means operatively mounted on said water feeding pipe for controlling the flow of feed water to said upper water tank, means for detecting a predetermined water level in said upper water tank and controlling said first valve means in response thereto, heater means provided for heating water in said lower water tank, hot water discharge means for discharging hot water from said lower water tank, generally vertically extending conduit means communicating said lower water tank with the space immediately above the water level in said upper water tank, said vertically extending conduit opening upwardly over said predetermined water level in said upper water tank, wherein said hot water discharge means comprises a plurality of hot water discharge pipes communicating between said lower water tank and a common hot water port, each said pipe being provided with electromagnetically operated valve means, each said valve means being connected to and operated by a control circuit for energizing a selected valve means during a predetermined time period, a timer means for establishing said predetermined time period and a plurality of manually operated switches for selecting the specific valve means to be energized whereby different amounts of hot water may be selectively discharged from said common hot water port during a constant time period.

* * * * *